US007680449B2

(12) United States Patent
Shimizu

(10) Patent No.: US 7,680,449 B2
(45) Date of Patent: Mar. 16, 2010

(54) IMAGE-FORMING APPARATUS

(75) Inventor: Takashi Shimizu, Kakamigahara (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 416 days.

(21) Appl. No.: 11/613,547

(22) Filed: Dec. 20, 2006

(65) Prior Publication Data

US 2007/0147920 A1 Jun. 28, 2007

(30) Foreign Application Priority Data

Dec. 27, 2005 (JP) ..... 2005-373891

(51) Int. Cl.
*G03G 15/00* (2006.01)

(52) U.S. Cl. ..... 399/400; 399/397

(58) Field of Classification Search ..... 399/397, 399/400

See application file for complete search history.

(56) References Cited

U.S. PATENT DOCUMENTS 7,269,385 B2 * 9/2007 Kimura et al. ..... 399/397
7,532,853 B2 * 5/2009 Shimizu ..... 399/400

FOREIGN PATENT DOCUMENTS

JP 06314005 A * 11/1994
JP 2002-328552 11/2002

* cited by examiner

*Primary Examiner*—Judy Nguyen
*Assistant Examiner*—Allister Primo
(74) *Attorney, Agent, or Firm*—Banner & Witcoff, Ltd.

(57) ABSTRACT

A guide body for guiding the back surface of toner-image-bearing paper is formed from an insulating material and is disposed so as to face a paper transport path. A paper-transport-path-facing portion of the guide body, which faces the paper transport path, has guide ribs projecting upward toward the paper. A covering metal sheet is configured such that a covering portion thereof partially covers a guide surface of the paper-transport-path-facing portion which faces the paper transport path. The covering metal sheet has slits formed therein and corresponding to the guide ribs. The slits allow the guide surface to be partially exposed therethrough.

27 Claims, 6 Drawing Sheets

IMAGE-FORMING APPARATUS

CROSS-REFERENCE TO RELATED APPLICATIONS

This Nonprovisional application claims priority under 35 U.S.C. §119(a) on Patent Application No. 2005-373891 filed in Japan on Dec. 27, 2005, the entire contents of which are hereby incorporated by reference.

BACKGROUND OF THE INVENTION

1. Field of the Invention

The present invention relates to an image-forming apparatus in which, after a charged-developing agent is affixed to the surface of a recording medium in image-wise arrangement, the image in the developing agent is fixed on the recording medium, thereby forming the image on the recording medium.

2. Description of the Related Art

An example of this type of image-forming apparatus is a widely known electrophotographic image-forming apparatus. As described in, for example, Japanese Patent Application Laid-Open (kokai) No. 2002-328552, this electrophotographic image-forming apparatus includes a photoconductor drum, a charging device, an exposing device, a developing device, a transfer roller, a fixing device, and a transport guide.

The photoconductor drum is disposed in a process cartridge, which partially constitutes image-forming means. The charging device is configured so as to uniformly charge the surface of the photoconductor drum. The exposing device is configured so as to expose the surface of the photoconductor drum which is uniformly charged by the charging device, thereby forming an electrostatic latent image on the surface.

The developing device is configured so as to affix charged toner (developing agent) to the surface of the photoconductor drum on which the latent image is formed, in an image-wise pattern corresponding to the latent image. In other words, this developing device is configured so as to develop the latent image by use of the toner. Hereinafter, an image which is formed through attachment of the developing agent (toner) in image-wise arrangement is simply called a "developing-agent image (toner image)."

The transfer roller is configured so as to electrostatically transfer the toner image from the surface of the photoconductor drum to the surface of the recording medium. The fixing device is configured so as to fix the toner image on the surface of the recording medium through application of heat and/or pressure to the recording medium on which the toner image has been transferred by means of the transfer roller. The transport guide is configured so as to guide transport of the recording medium which has passed the transfer roller, toward the fixing device.

In the image-forming apparatus described in Japanese Patent Application Laid-Open (kokai) No. 2002-328552, the transport guide includes transport ribs and a metal sheet. A static-eliminating member is provided upstream of the transport guide with respect to the recording-medium transport direction.

The metal sheet is grounded. This metal sheet is configured so as to stably transport the recording medium through electrostatic attraction of the non-image side (back surface) of the recording medium which has passed the transfer roller.

The transport ribs are formed from a synthetic resin and provided in such a manner as to project toward the recording medium. The transport ribs are configured so as to lower transport resistance of the recording medium and to restrain occurrence of an abnormal image which could otherwise result from disturbance of the unfixed toner image during passage of the recording medium through the transport guide.

Conceivably, occurrence of an abnormal image is due to an exchange of charges between the back surface of the recording medium and the transport guide at the time the recording medium bearing the unfixed toner image comes in proximity to or in direct contact with the electrically conductive metal sheet.

The static-eliminating member is formed of a grounded, electrically conductive member and is configured so as to eliminate static charges from the back surface of the recording medium. That is, through elimination of static charges from the back surface of the recording medium by means of the static-eliminating member, the recording medium which has passed the transfer roller can be smoothly transported toward the transport guide and the fixing device.

The thus-configured image-forming apparatus encounters extreme difficulty in completely solving the above-mentioned problem of occurrence of an abnormal image during passage of the recording medium through the transport guide.

For example, if the amount of static charges on the back surface of the recording medium is excessively large or small, the above-mentioned abnormal image arises remarkably. This abnormal image arises in the form of streaky "trace of ribs" along the transport direction at positions corresponding to the transport ribs or radial "scatter".

Conceivably, "trace of ribs" arises through the following mechanism. In the case of accumulation of an excessively large amount of static charges on the back surface of the recording medium, the electrostatic attraction between the recording medium and the metal sheet becomes excessively strong. This excessively strong, electrostatic attraction causes strong friction between ends of the transport ribs and the back surface of the recording medium moving in the transport direction. This strong friction generates charges. The thus-generated charges cause adsorption or scatter of the toner; i.e., charged particles. Also, discharge of the charges causes scatter of the toner. As a result, a streaky disturbance of image arises along the transport direction.

Conceivably, "scatter" arises through the following mechanism. In the case of accumulation of an excessively large amount of static charges on the back surface of the recording medium, discharge occurs between the back surface and the transport guide. This discharge causes scatter of the toner; i.e., charged particles. As a result, a radial disturbance of image arises along the transport direction.

Meanwhile, various adverse effects also arise when the amount of static charges on the back surface of the recording medium becomes excessively small as a result of excessive elimination of static charges from the back surface of the recording medium by means of the static-eliminating member, which is located upstream of the transport guide with respect to the transport direction. In this case, the electrostatic attraction between the recording medium and the metal sheet becomes excessively weak, thereby causing loss of stability of transport of the recording medium. In this case, the above-mentioned "scatter" also arises.

Conceivably, "scatter" in this case arises through the following mechanism. Excessive elimination of static charges from the back surface of the recording medium causes a relative drop in an electrostatic adsorbing force with which the toner adsorbs on the recording medium. Then, for example, during transport of the recording medium, a certain (mechanical or electrostatic) impact exerted locally on the recording medium causes scatter of the toner. As a result, a radial disturbance of image arises along the transport direction.

The above-mentioned abnormal image which occurs during passage of the recording medium through the transport guide is particularly likely to occur on the second side of a sheet when both sides of a sheet undergo image-forming. Conceivably, this is because a drop in water content of the recording medium and the occurrence of a curl of the recording medium as a result of passage through the fixing device cause a change in the degree of friction of the recording medium against the transport ribs and in electrostatic propensity of the recording medium.

However, controlling the electrostatically charged condition of the back surface of the recording medium by means of the static-eliminating member is very difficult. This is because the condition of electrostatic charge varies greatly depending on, for example, the environment in which the image-forming apparatus is used, and the material of the recording medium. Also, as mentioned above, the condition of the electrostatic charge could differ greatly between the first side and the second side in double-sided image formation.

In this connection, appropriately controlling the electrostatic attraction between the recording medium and the metal sheet through application of a predetermined bias voltage between the metal sheet and the ground potential is also difficult. This is because the polarity of and the amount of static charges on the back surface of the recording medium could vary depending on the material of the recording medium and the materials of elements disposed in the image-forming apparatus, and thus appropriately setting the polarity of the bias voltage is difficult.

Particularly, when the material of the recording medium and the materials of elements disposed in the image-forming apparatus are positioned close to one another on a frictional electrification sequence, the polarity of static charges on the back surface of recording medium cannot be fixed.

Furthermore, the configuration of the image-forming apparatus becomes complex; for example, necessity arises for a power unit to be connected to the metal sheet, and a circuit for this connection. As a result, provision of an inexpensive image-forming apparatus becomes difficult.

SUMMARY OF THE INVENTION

The present invention has been accomplished to solve the above problems, and an object of the invention is to provide an image-forming apparatus in which occurrence of an abnormal image during transport of a recording medium bearing an unfixed toner image is restrained to a greater extent than in the case of a conventional image-forming apparatus.

An image-forming apparatus of the present invention comprises a developing-agent-image-forming section, a fixing section, and a recording-medium guide section.

The developing-agent-image-forming section is configured so as to affix a charged-developing agent to the surface of a recording medium in a pattern corresponding to an image. That is, the developing-agent-image-forming section is configured so as to form an image in the developing agent on the surface of the recording medium. The fixing section is configured so as to fix the developing-agent image on the recording medium.

The recording-medium guide section is disposed between the developing-agent-image-forming section and the fixing section in such a manner as to face the back surface of the recording medium. Herein, the back surface of the recording medium is opposite the surface of the recording medium on which the developing-agent image is formed in the developing-agent-image-forming section. The recording-medium guide section is configured so as to guide transport, to the fixing section, of the recording medium bearing the developing-agent image formed at the developing-agent-image-forming section.

Specifically, the recording medium guide section comprises a guide member and an electrically conductive member.

The guide member has a plurality of ribs. The plurality of ribs are provided in a standing condition on the facing surface of the guide member in opposition to the back surface of the recording medium.

The electrically conductive member is configured so as to cover the facing surface of the guide member. The electrically conductive member has opening portions for allowing exposure therethrough of the ribs of the guide member toward the back surface of the recording medium.

The present invention is characterized in that the electrically conductive member has the opening portions for allowing exposure therethrough of a portion of the facing surface of the guide member and the ribs of the guide member toward the back surface of the recording medium and is configured so as to cover the remaining portion of the facing surface.

That is, according to the present invention, the electrically conductive member is configured such that a predetermined clearance is formed between an edge of the opening portion and a side surface of the rib.

In the above configuration, the portion of the electrically conductive member which covers the remaining portion of the facing surface of the guide member faces the recording medium on which the developing-agent image is formed. Thus, electrostatic attraction is generated therebetween. This electrostatic attraction is weakened appropriately as compared with the case where the electrically conductive member covers the entire facing surface of the guide member. The electrically conductive member attracts the back surface of the recording medium transported from the developing-agent-image-forming section with this appropriate electrostatic attraction, whereby the recording medium is stably transported.

According to the present invention having the above-mentioned configuration, when the recording medium bearing the unfixed developing-agent image passes through the recording-medium guide section, generation of excessive electrostatic attraction is restrained. Therefore, according to the present invention, occurrence of an abnormal image associated with transport of the recording medium bearing an unfixed image can be effectively restrained.

According to the present invention, particularly, in the case where the image-forming apparatus has a paper-inverting mechanism, occurrence of an abnormal image associated with image formation on the second side of the recording medium which has passed through the fixing section and bears a fixed image on the first side can be restrained more effectively. The paper-inverting mechanism is configured so as to invert the recording medium which has passed through the fixing section and on which the developing-agent image is fixed and to refeed the inverted recording medium to the developing-agent-image-forming section.

In the above-mentioned configuration, the opening portions of the electrically conductive member may be greater in width or area than the portion of the electrically conductive member which covers the facing surface of the guide member.

By virtue of this, even when the recording medium is charged strongly, generation of excessive electrostatic attraction can be restrained.

In this case, in the electrically conductive member, the width or area of the opening portions may be set as mentioned above at least in a central region thereof with respect to the transport direction of the recording medium. The central region of the electrically conductive member with respect to the transport direction consists of a region which comes closest to the recording medium, and its peripheral region. Setting the width or area of the opening portions as mentioned above can more effectively restrain occurrence of an abnormal image.

The electrically conductive member may be configured such that the width or area of the opening portions differs between a central region thereof with respect to a width direction thereof perpendicular to a thickness direction of the recording medium and to the transport direction of the recording medium and end regions thereof with respect to the width direction thereof. Specifically, for example, the width or area of the opening portions in the central region can be set greater than the width or area of the opening portions in the end regions.

In the case where the recording medium curls along the width direction of the electrically conductive member, the above configuration allows appropriate distribution of widths or areas of the opening portions along the width direction in accordance with the tendency of the curl. Thus, even when the recording medium curls as mentioned above, occurrence of an abnormal image can be restrained more effectively.

DESCRIPTION OF THE PREFERRED EMBODIMENT

An embodiment of the present invention (an embodiment which the applicants of the present invention considered the best at the time of filing the present patent application) will next be described in detail with reference to the drawings.

Figure 1:
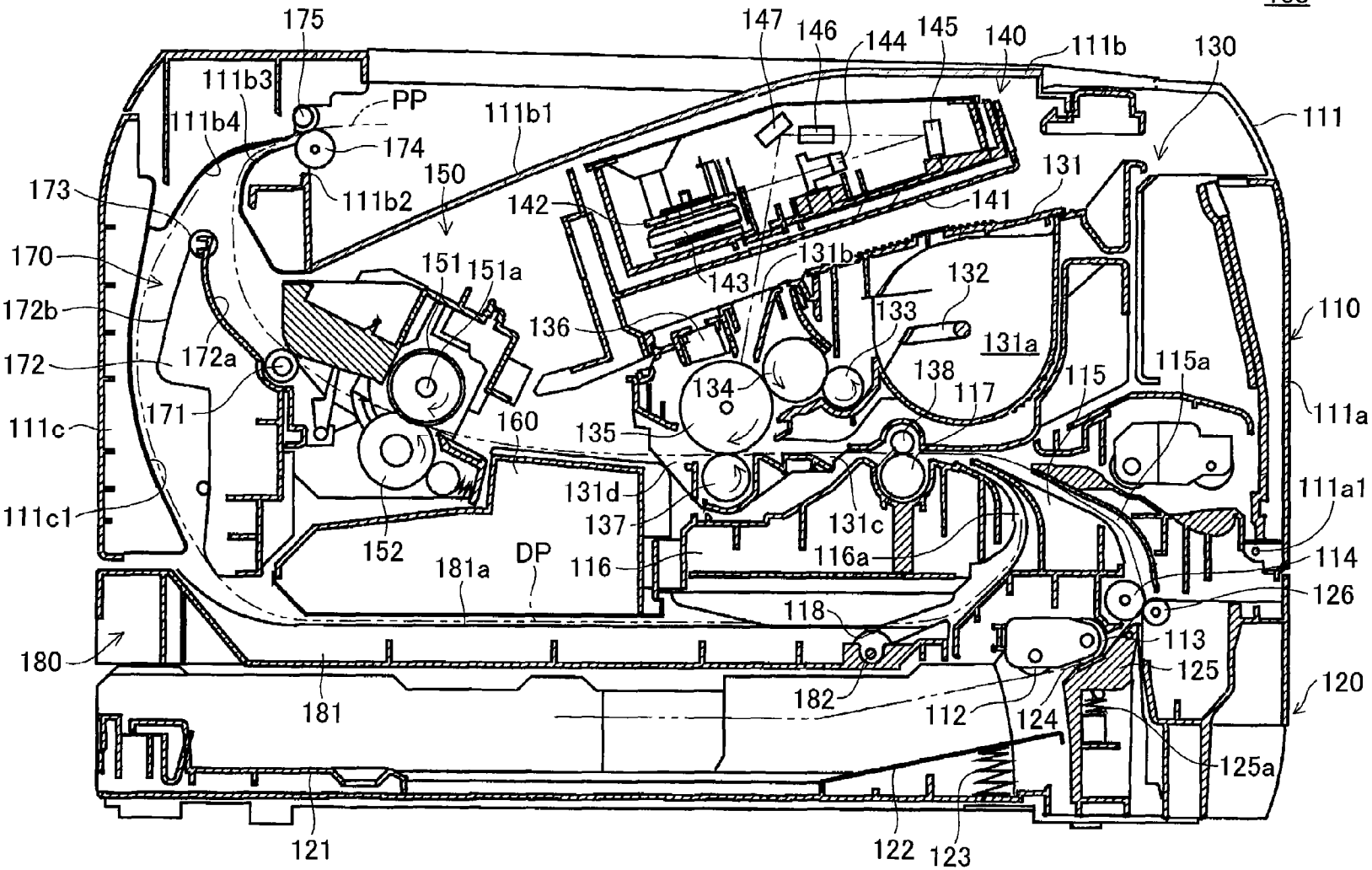
FIG. 1 is a cross-sectional view of a laser printer, which is an embodiment of an image-forming apparatus of the present invention.

Overall Configuration of Laser Printer:

FIG. 1 is a cross-sectional view of a laser printer 100, which is an embodiment of an image-forming apparatus of the present invention.

The laser printer 100 includes a body section 110 and a feeder unit 120. The body section 110 is configured so as to form an image on paper (recording medium) while transporting paper fed from the feeder unit 120 along a paper transport path PP (shown by the alternate-long-and-two-short-dashes line in FIG. 1).

In the following description, the direction of transport of paper along the paper transport path PP in FIG. 1 is called the "paper transport direction." That is, the "paper transport direction" at a certain position on the paper transport path PP is parallel with a tangent to the paper transport path PP at the position and coincides with a moving direction of paper at the position.

A direction perpendicular to the paper transport path PP; i.e., a direction perpendicular to paper of FIG. 1, is called the "width direction." The "width direction" coincides with the width direction of paper. The "width direction" is perpendicular to the thickness direction of paper, the height direction of the laser printer 100, and the paper transport direction.

Furthermore, the right side of the laser printer 100 in FIG. 1 is called the "front side" of the laser printer 100, and the left side of the laser printer 100 in FIG. 1 is called the "rear side" of the laser printer 100.

The feeder unit 120 is disposed under the body section 110. The feeder unit 120 is configured so as to hold stacked sheets of paper to be fed into the body section 110. In the present embodiment, the laser printer 100 and the feeder unit 120 are configured so as to accept letter size (215.9 mm×279.4 mm) and A4 size (210 mm×297 mm) paper.

The body section 110 accommodates an image-forming unit 130, a scanner unit 140, a fixing section 150, an unfixed-image-bearing-paper transport guide 160, and a fixed-image-bearing-paper transport section 170.

The image-forming unit 130 is configured so as to form an image in toner (developing agent) on paper. The image-forming unit 130 is removable from the body section 110.

The scanner unit 140 is configured so as to generate a laser beam used to form a toner image in the image-forming unit 130 and to irradiate the laser beam toward the image-forming unit 130.

The fixing section 150 is configured so as to fix a toner image which is formed on paper by the image-forming unit 130.

The unfixed-image-bearing-paper transport guide 160 is disposed in such a manner as to face the back surface of paper (i.e., a surface of paper opposite the surface of paper on which a toner image is formed). The unfixed-image-bearing-paper transport guide 160 is disposed between the image-forming unit 130 and the fixing section 150. The unfixed-image-bearing-paper transport guide 160 is configured so as to guide transport, to the fixing section 150, of paper bearing an unfixed toner image and transported from the image-forming unit 130.

The fixed-image-bearing-paper transport section 170 is configured so as to eject, to the exterior of the body section 110, paper bearing a fixed toner image and transported from the fixing section 150. The fixed-image-bearing-paper transport section 170 is also configured so as to refeed paper which had a toner image fixed on the first side by the fixing section 150, toward the image-forming unit 130 along a paper inversion path DP (shown by the alternate-long-and-two-short-dashes line in FIG. 2) in the case where an image is to be formed on both sides of paper.

A paper-inverting unit 180 is provided between the body section 110 and the feeder unit 120. The paper-inverting unit 180 is configured so as to receive paper transported by the fixed-image-bearing-paper transport section 170 in the case where an image is to be formed on both sides of paper.

Next will be described specific configurations of the image-forming unit 130, the scanner unit 140, the fixing section 150, the unfixed-image-bearing-paper transport guide 160, the fixed-image-bearing-paper transport section 170, and the paper-inverting unit 180.

Body Section:

The body section 110 has a body frame (not shown) configured so as to support the image-forming unit 130 and the like. This body frame is formed from metal or a synthetic resin.

The body section 110 has a pick-up roller 112 provided at a bottom portion thereof at a position biased toward the front side. The pick-up roller 112 is a rubber roller. The pick-up roller 112 is configured so as to send, in the paper transport direction, sheets of paper in a top portion of a stack of sheets of paper in the feeder unit 120.

A separating roller 113 is provided in the way of paper delivered by the pick-up roller 112. The separating roller 113 is a rubber roller. The separating roller 113 is configured so as to separate only the top sheet of paper and to transport the separated sheet toward the image-forming unit 130 in cooperation with a separating pad 124, which is provided in the feeder unit 120 and will be described later.

A paper feed roller 114 is provided in the way of paper delivered by the separating roller 113. The paper feed roller 114 is a rubber roller. The paper feed roller 114 is configured so as to transport, toward the image-forming unit 130, paper which has been separated by the separating roller 113 (and the separating pad 124).

A downstream-of-feeder paper guide 115 is provided in the way of paper delivered by the paper feed roller 114.

The downstream-of-feeder paper guide 115 is configured so as to guide paper sent from the feeder unit 120, toward a resist section, which is located underneath the image-forming unit 130 and will be described later. The downstream-of-feeder paper guide 115 forms a downstream-of-feeder paper feed path 115*a*. Paper sent from the feeder unit 120 passes through the downstream-of-feeder paper feed path 115*a* and reaches the resist section.

A downstream paper guide 116 is provided underneath the image-forming unit 130 and at the rear side of the downstream-of-feeder paper guide 115. A space between the downstream paper guide 116 and the downstream-of-feeder paper guide 115 serves as an inverted-paper feed path 116*a*.

The inverted-paper feed path 116*a* is a termination portion of a paper-inverting path DP. That is, paper which has been received in the paper-inverting unit 180 is transported toward the resist section through the inverted-paper feed path 116*a*.

A resist roller 117 is provided at a top end portion of the downstream paper guide 116. The resist roller 117 is configured so as to correct a skew of the leading end of paper and to adjust the timing of passing of the leading end of the paper, in cooperation with an opposite roller 138, which is provided at a bottom portion of the image-forming unit 130 and will be described later.

An inverted-paper feed roller 118 is provided at a position which faces a front end portion of the paper-inverting unit 180. The inverted-paper feed roller 118 is configured so as to send, toward the resist section, paper which has been once received in the paper-inverting unit 180.

The pick-up roller 112, the separating roller 113, the paper feed roller 114, the resist roller 117, and the inverted-paper feed roller 118 are configured so as to be rotatably driven via an unillustrated rotational-drive-force transmission mechanism.

Body Cover:

The body section 110 has a body cover 111. The body cover 111 is formed so as to cover the exterior of the body frame. The body cover 111 is formed from a plate material of a synthetic resin.

A front cover 111*a* is provided at the front side of the body cover 111. The front cover 111*a* is supported in such a manner as to be rotatable about a front cover pivot 111*a*1 located at a lower end portion thereof.

The body cover 111 of the laser printer 100 of the present embodiment is configured such that the front cover 111*a* is opened by means of its upper end portion being pivoted toward the front side (rightward in FIG. 1). Opening the front cover 111*a* forms an opening portion at the front side of the body cover 111 for allowing attachment/detachment of the image-forming unit 130.

A recess portion is formed at the rear side (left side in FIG. 1) of a top cover 111*b*, which forms an upper panel of the body cover 111. This recess portion is formed in such a manner as to become deeper from the front side (right side in FIG. 1) toward the rear side. The recess portion forms a catch tray 111*b*1.

That is, the catch tray 111*b*1 includes an inclined plane which extends obliquely downward from the front side (right side in FIG. 1) of the top cover 111*b* toward the rear side (left side in FIG. 1). The catch tray 111*b*1 is configured so as to allow stacking of tens of image-formed sheets of paper thereon.

The body cover 111 has a paper ejection port 111*b*2 in the form of an opening located above a lower end portion (a left, lower end portion in FIG. 1) of the catch tray 111*b*1. The catch tray 111*b*1 is configured so as to receive paper which is ejected through the paper ejection port 111*b*2 and on which an image has been formed.

The inner surface of a rear portion of the top cover 111*b* has a lower paper-ejection-port guide 111*b*3 and an upper paper-ejection-port guide 111*b*4 formed thereon. The lower paper-ejection-port guide 111*b*3 and the upper paper-ejection-port guide 111*b*4 are formed so as to guide, toward the paper ejection port 111*b*2, paper which has passed the fixing section 150 and is ejected toward the catch tray 111*b*1. In addition, the upper paper-ejection-port guide 111*b*4 is configured so as to guide the rear end of paper sent close to the paper ejection port 111*b*2, toward the paper inversion path DP when the paper is to undergo double-sided image formation.

The body cover 111 has a rear cover 111*c* at the rear side. The rear cover 111*c* is removably configured so as to allow treatment of paper jam or a like problem upon occurrence of such a problem. A paper inversion path guide 111*c*1 is formed at the inside (i.e., on the front side) of the rear cover 111*c*. The paper inversion path guide 111*c*1 is provided along the paper inversion path DP.

Feeder Unit:

The feeder unit 120 includes a feeder case 121, a paper-pressing plate 122, a paper-pressing spring 123, the separating pad 124, a separating-pad holder 125, and a paper-dust-removing roller 126.

The feeder case 121 is a member which forms the casing of the feeder unit 120. The feeder case 121 is formed from a plate material of the same synthetic resin as that used to form the body cover 111. The feeder unit 120 is configured so as to accommodate a large number of stacked sheets of paper.

The paper-pressing plate 122 is disposed within the feeder case 121. The paper-pressing plate 122 is supported pivotably at a rear end portion thereof. The paper-pressing spring 123 biases upward a front end portion of the paper-pressing plate 122.

The separating pad 124 faces the separating roller 113. The separating pad 124 is formed from a material whose coefficient of friction against paper is greater than coefficient of friction between sheets of paper. For example, the separating pad 124 may be formed from felt.

The separating-pad holder 125 is a member for supporting the separating pad 124. The separating-pad holder 125 is disposed underneath the separating roller 113. A separating-pad-biasing spring 125*a* biases the separating-pad holder 125 upward toward the separating roller 113.

The paper-dust-removing roller 126 is provided at a front end portion of the feeder case 121. The paper-dust-removing roller 126 faces the paper feed roller 114. The paper-dust-removing roller 126 is configured so as to remove foreign matter, such as paper dust, attached to paper which is to undergo image formation.

Image-Forming Unit:

A developing-section case 131 is formed from a synthetic resin and serves as a casing and frame of the image-forming unit 130. The developing-section case 131 has a toner accommodation section 131*a* formed at the front side thereof. The toner accommodation section 131*a* is a space for accommodating nonmagnetic one-component toner which serves as a developing agent.

An agitator 132 in the form of an impeller is disposed within the accommodation section 131*a*. The agitator 132 is rotatably supported by the developing-section case 131. The agitator 132 is configured so as to stir toner accommodated within the toner accommodation section 131*a* by means of being rotatably driven. The agitator 132 is also configured so as to send toner in a small amount toward a feed roller 133.

The feed roller 133 is disposed at the inside of the developing-section case 131 and on the rear side of the toner accommodation section 131*a*. The feed roller 133 is configured such that a sponge layer is formed on an outer circumferential portion of a rotational shaft made of metal. The feed roller 133 is rotatably supported by the developing-section case 131. In the course of image formation, the feed roller 133 is rotatably driven in the direction represented by the arrow in FIG. 1 (counterclockwise) via an unillustrated rotational-drive-force transmission mechanism.

A developing roller 134 is disposed at the inside of the developing-section case 131 and on the rear side of the feed roller 133. The developing roller 134 is disposed in parallel with the feed roller 133. The axis-to-axis distance between the developing roller 134 and the feed roller 133 is set such that the developing roller 134 presses the feed roller 133 in such a manner as to elastically compress the feed roller 133.

The developing roller 134 is configured such that a semiconducting rubber layer is formed on an outer circumferential portion of a rotational shaft made of metal. This semiconducting rubber layer is formed by mixing carbon black in a synthetic rubber and uniformly dispersing the carbon black.

The developing roller 134 is rotatably supported by the developing-section case 131. In the course of image formation, the developing roller 134 is rotatably driven in the direction represented by the arrow in FIG. 1 (counterclockwise; i.e., in the same direction as the rotating direction of the feed roller 133) via an unillustrated rotational-drive-force transmission mechanism. Rotatably driving the developing roller 134 causes the circumferential surface of the developing roller 134 carries a charged toner.

A photoconductor drum 135 is disposed at the inside of the developing-section case 131 and on the rear side of the developing-roller 134. The photoconductor drum 135 is a cylindrical member whose outer circumferential portion has a photoconductor layer made of a photoconductive substance formed thereon.

The photoconductor drum 135 is disposed in parallel with the developing roller 134. The axis-to-axis distance between the photoconductor drum 135 and the developing roller 134 is set such that the circumferential surface of the photoconductor drum 135 and the circumferential surface of the developing roller 134 come into contact with each other via a thin toner layer carried on the circumferential surface of the developing roller 134.

A charger 136 is disposed above the photoconductor drum 135. The charger 136 is supported by the developing-section case 131. The charger 136 is a known scorotron-type charger and is configured so as to uniformly charge the circumferential surface of the photoconductor drum 135.

A laser irradiation opening 131*b* is formed at an upper portion of the developing-section case 131 and between the charger 136 and the developing roller 134. The laser irradiation opening 131*b* allows a laser beam modulated according to image information to irradiate the circumferential surface of the photoconductor drum 135, which is uniformly charged by the charger 136, so as to form an electrostatic latent image on the circumferential surface of the photoconductor drum 135.

The image-forming unit 130 is configured such that the thus-formed electrostatic latent image on the circumferential surface of the photoconductor drum 135 is developed with toner carried on the circumferential surface of the developing roller 134 so as to be formed into a toner image on the circumferential surface on the photoconductor drum 135.

A transfer roller 137 is disposed at the inside of the developing-section case 131 and underneath the photoconductor drum 135. The transfer roller 137 is disposed in parallel with the photoconductor drum 135 so as to face the circumferential surface of the photoconductor drum 135 with the paper transport path PP intervening therebetween.

A paper inlet opening 131*c* is formed upstream, with respect to the paper transport direction, of a transfer position where the transport roller 137 and the photoconductor drum 135 face each other. A paper outlet opening 131*d* is formed downstream of the transfer position with respect to the paper transport direction. That is, paper which has been fed toward the image-forming unit 130 enters the image-forming unit 130 through the paper inlet opening 131*c*, passes the transfer position, and then leaves the image-forming unit 130 through the paper outlet opening 131*d*.

The transfer roller 137 is rotatably supported by the developing-section case 131. The transfer roller 137 is configured such that a semiconducting rubber layer is formed on an outer circumferential portion of a rotational shaft made of metal. An unillustrated high-voltage output terminal of a high-voltage power source is connected to this rotational shaft.

In the course of image formation, as a result of being dragged by rotation of the photoconductor drum 135, the transfer roller 137 is rotatably driven in the direction represented by the arrow in FIG. 1 (counterclockwise) and synchronously with rotation of the photoconductor drum 135 in the direction represented by the arrow in FIG. 1 (clockwise). The transfer roller 137 is configured such that, while being rotatably driven as mentioned above, and through application of a predetermined voltage between the transfer roller 137 and the photoconductor drum 135, the transfer roller 137 causes transfer of toner carried on the circumferential surface of the photoconductor drum 135 to paper at the transfer position.

The opposite roller 138 is provided at the outside of a bottom portion of the developing-section case 131 and upstream of the paper inlet opening 131*c* with respect to the paper transport direction. The opposite roller 138 is rotatably supported by the developing-section case 131.

The opposite roller 138 is disposed in parallel with the resist roller 117. Additionally, the opposite roller 138 is disposed in opposition to the resist roller 117. The opposite roller 138 is configured and disposed so as to be rotated as a result of being dragged by rotation of the resist roller 117 through contact with the resist roller 117. A contact portion between the opposite roller 138 and the resist roller 117 serves as the resist section for once stopping the leading end of paper, correcting a skew of the paper, and adjusting transport timing of the paper.

Scanner Unit:

The scanner unit 140 is disposed above the developing-section case 131. The scanner unit 140 includes a scanner case 141, a polygon mirror 142, a polygon motor 143, an f-θ lens 144, a turnover mirror 145, a cylindrical lens 146, and an irradiation mirror 147.

The polygon mirror 142 is supported by a rotational drive shaft of the polygon motor 143 fixed to the scanner case 141. The polygon mirror 142 is configured such that, while being rotatably driven at a predetermined rotational speed by the polygon motor 143, the polygon mirror 142 reflects a laser beam which is generated on the basis of image data in an unillustrated laser beam generator, whereby the laser beam sweeps along the width direction.

The f-θ lens 144 is adapted to correct sweep spacing of the laser beam (represented by the alternate-long-and-short-dash line in FIG. 1) reflected by the polygon mirror 142 and is configured so as to have a longitudinal direction along the rotational direction of the polygon mirror 142. The f-θ lens 144 is disposed between the polygon mirror 142 and the turnover mirror 145.

The cylindrical lens 146 is adapted to correct planar inclination and is disposed in the way of a laser beam which has passed through the f-θ lens 144 and has then been reflected by the turnover mirror 145. The irradiation mirror 147 is disposed so as to irradiate, toward the circumferential surface of the photoconductor drum 135, a laser beam which has passed through the cylindrical lens 146.

The f-θ lens 144, the turnover mirror 145, the cylindrical lens 146, and the irradiation mirror 147 are supported within the scanner case 141.

Fixing Section:

The fixing section 150 is disposed downstream of the transfer position with respect to the paper transport direction. The fixing section 150 includes a heating roller 151 and a pressure roller 152.

The heating roller 151 is configured such that a heater 151*a* is accommodated within a thin-walled hollow cylinder whose surface is exfoliation-treated and which is made of metal. The heating roller 151 is disposed in parallel with the width direction.

The pressure roller 152 is made of silicone rubber and is disposed in parallel with the heating roller 151. The pressure roller 152 is pressed against the heating roller 151 under a predetermined pressure by means of a spring or the like.

The fixing section 150 is configured such that the heating roller 151 rotating in the direction represented by the arrow in FIG. 1 and the pressure roller 152 hold paper therebetween to thereby fix, on the upper (in FIG. 1) surface of paper, a toner image transferred to the upper surface and to feed the paper in the paper transport direction.

Unfixed-Image-Bearing-Paper Transport Guide:

The unfixed-image-bearing-paper transport guide 160 is provided between the paper outlet opening 131*d* of the image-forming unit 130 and the fixing section 150. The unfixed-image-bearing-paper transport guide 160 is disposed in opposition to the paper transport path PP. The unfixed-image-bearing-paper transport guide 160 is configured so as to guide transport, to the fixing section 150, of paper bearing a toner image and transported from the image-forming unit 130. The configuration of the unfixed-image-bearing-paper transport guide 160 will be described in detail later.

Fixed-Image-Bearing-Paper Transport Section:

The fixed-image-bearing-paper transport section 170 includes a fixed-image-bearing-paper delivery roller 171, a fixed-image-bearing-paper guide 172, a fixed-image-bearing-paper guide roller 173, a paper-ejection drive roller 174, and a paper-ejection follower roller 175.

The fixed-image-bearing-paper delivery roller 171 is disposed in the way of paper delivered by the heating roller 151 and the pressure roller 152 of the fixing section 150. The fixed-image-bearing-paper delivery roller 171 is configured so as to deliver paper bearing a toner image and transported from the fixing section 150, toward a space between the lower paper-ejection-port guide 111*b*3 and the upper paper-ejection-port guide 111*b*4.

The fixed-image-bearing-paper guide 172 is configured so as to guide paper bearing a fixed image and delivered by the fixed-image-bearing-paper delivery roller 171, toward a space between the lower paper-ejection-port guide 111*b*3 and the upper paper-ejection-port guide 111*b*4.

A fixed-image-bearing-paper ejection guide surface 172*a*, which is the front surface of fixed-image-bearing-paper guide 172, is formed in such a manner as to extend along the paper transport path PP. That is, the fixed-image-bearing-paper ejection guide surface 172*a*, which is the surface of the fixed-image-bearing-paper guide 172 facing the paper transport path PP, is configured so as to smoothly guide fixed-image-bearing paper toward a space between the lower paper-ejection-port guide 111*b*3 and the upper paper-ejection-port guide 111*b*4.

The fixed-image-bearing-paper guide 172 has a fixed-image-bearing-paper suction guide surface 172*b* formed at the rear side thereof. The fixed-image-bearing-paper suction guide surface 172*b* is provided in opposition to the paper inversion path guide 111*c*1 of the rear cover 111*c*. That is, a space sandwiched between the fixed-image-bearing-paper suction guide surface 172*b* and the paper inversion path guide 111*c* forms the paper inversion path DP extending from a space between the lower paper-ejection-port guide 111*b*3 and the upper paper-ejection-port guide 111*b*4 to the paper-inverting unit 180.

The fixed-image-bearing-paper guide roller 173 is rotatably supported at the upper end of the fixed-image-bearing-paper guide 172. The fixed-image-bearing-paper guide roller 173 is configured and disposed so as to lower friction between the upper end of the fixed-image-bearing-paper guide 172 and paper which is delivered downward of the fixing section 150 with respect to the paper transport direction. The fixed-image-bearing-paper guide roller 173 is also configured and disposed so as to lower friction between the upper end of the fixed-image-bearing-paper guide 172 and paper which is delivered toward the paper-inverting unit 180 along the paper inversion path DP.

The paper-ejection drive roller 174 and the paper-ejection follower roller 175 are disposed such that the front side thereof is exposed to the exterior of the top cover 111*b* from the paper ejection port 111b2 of the top cover 111b. The paper-ejection drive roller 174 and the paper-ejection follower roller 175 are disposed such that the rear side thereof is accommodated in the interior of the top cover 111b.

The paper-ejection drive roller 174 is configured so as to be reversibly rotated; i.e., to be rotated clockwise and counterclockwise in FIG. 1, by means via an unillustrated rotational-drive-force transmission mechanism. That is, the paper-ejection drive roller 174 is configured so as to eject paper to the catch tray 111b1 by means of being rotatably driven clockwise in FIG. 1. The paper-ejection drive roller 174 is also configured so as to deliver paper toward the paper-inverting unit 180 along the paper inversion path DP by means of being rotatably driven counterclockwise in FIG. 1.

The paper-ejection follower roller 175 is disposed above the paper-ejection drive roller 174. The paper-ejection follower roller 175 is rotatably supported by the top cover 111b. The paper-ejection follower roller 175 is rotated as a result of being dragged by rotation of the paper-ejection drive roller 174.

Paper-Inverting Unit:

The paper-inverting unit 180 includes an inversion tray 181 and an inverted-paper feed follower roller 182.

The inversion tray 181 is formed from a plate material of the same synthetic resin as that used to form the body cover 111 and the feeder case 121. The inversion tray 181 is configured so as to be drawn out toward the rear side for treatment of paper jam or a like problem; i.e., to be detachable from/attachable to the body section 110.

An inversion paper guide surface 181a is formed on the upper surface of the inversion tray 181. The inversion paper guide surface 181a extends along the paper inversion path DP.

The inversion paper guide surface 181a is configured so as to allow temporary rest thereon of paper which is caused, by reverse rotation of the paper-ejection drive roller 174, to pass through a space between the paper inversion path guide 111c1 and the fixed-image-bearing-paper suction guide surface 172b and then reach the inversion tray 181. The inversion paper guide surface 181a is configured so as to guide feed of fixed-image-bearing paper along the paper inversion path DP.

The inverted-paper feed follower roller 182 is rotatably supported at a front end portion of the paper inversion unit 180. The inverted-paper feed follower roller 182 is provided in parallel with the inverted-paper feed roller 118 at a position opposite the inverted-paper feed roller 118. The inverted-paper feed follower roller 182 is configured so as to be rotated as a result of being dragged by rotation of the inverted-paper feed roller 118 through contact with the inverted-paper feed roller 118.

That is, the inverted-paper feed follower roller 182 is configured so as to deliver, toward the resist section, paper which has been received in the paper inversion unit 180, in cooperation with the inverted-paper feed roller 118, which is rotatably driven via an unillustrated rotational-drive-force transmission mechanism.

Figure 2:
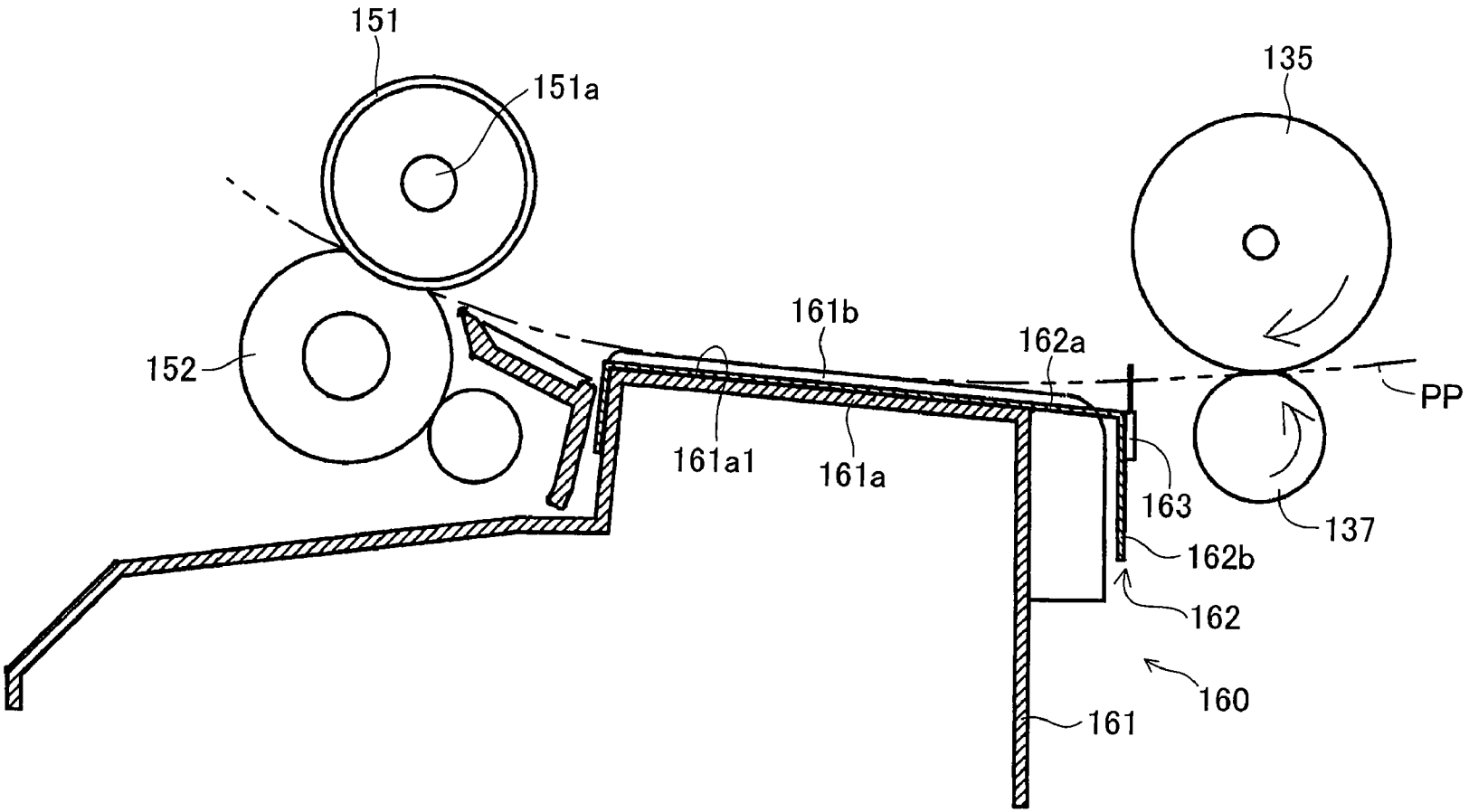
FIG. 2 is an enlarged cross-sectional view of an unfixed-image-bearing-paper transport guide shown in FIG. 1 and of its periphery.

Detailed Configuration of Unfixed-Image-Bearing-Paper Transport Guide:

FIG. 2 is an enlarged cross-sectional view of the unfixed-image-bearing-paper transport guide 160 shown in FIG. 1 and of its periphery. With reference to FIG. 2, the unfixed-image-bearing-paper transport guide 160 of the present embodiment includes a guide body 161, a covering metal sheet 162, and a static-eliminating brush 163.

The guide body 161 is integrally formed from an electrically insulative synthetic resin. The guide body 161 has a plate-like paper-transport-path-facing portion 161a. Guide ribs 161b are provided in a standing condition on an upper surface of the paper-transport-path-facing portion 161a; i.e., on a guide surface 161a1 facing the paper transport path PP, in such a manner as to project toward the paper transport path PP located above.

The guide ribs 161b are formed so as to extend along the paper transport direction. The guide ribs 161b are formed so as to be arranged along the width direction (paper width direction). In order to lower frictional resistance between paper and the unfixed-image-bearing-paper transport guide 160, the guide ribs 161b each have a width of approximately 0.8 mm to 2 mm. In the present embodiment, the width of the guide rib 161b is set to 1.2 mm.

The covering metal sheet 162 includes a covering portion 162a and a static-eliminating-brush support portion 162b. The covering metal sheet 162 is integrally formed from sheet metal by press working. The covering metal sheet 162 is grounded.

The covering portion 162a assumes the form of a flat sheet in parallel with the plate-like paper-transport-path-facing portion 161a of the guide body 161. The covering portion 162a is disposed so as to cover the guide surface 161a1, which is the upper surface of the paper-transport-path-facing portion 161a.

The static-eliminating-brush support portion 162b is provided, in a downward standing condition, at a front end portion; i.e., an upstream end portion with respect to the paper transport direction, of the covering portion 162a. The static-eliminating brush 163 is provided at the static-eliminating-brush support portion 162b. The static-eliminating brush 163 is directly, in mechanical terms and electric-circuit terms, connected to the static-eliminating-brush support portion 162b so as to have substantially the same electric potential as the covering metal sheet 162 (i.e., substantially 0 V).

The static-eliminating brush 163 is configured so as to restrain excessive charge-up of the back surface of paper which has passed the transfer position, where the photoconductor drum 135 and the transfer roller 137 face each other, for smooth ejection of the paper from the transfer position. The static-eliminating brush 163 is also configured so as to restrain excessive charge-up of the back surface of the above-mentioned paper for smooth transport of the paper toward a fixing position, which is a press-contact region between the heating roller 151 and the pressure roller 152.

Figure 3:
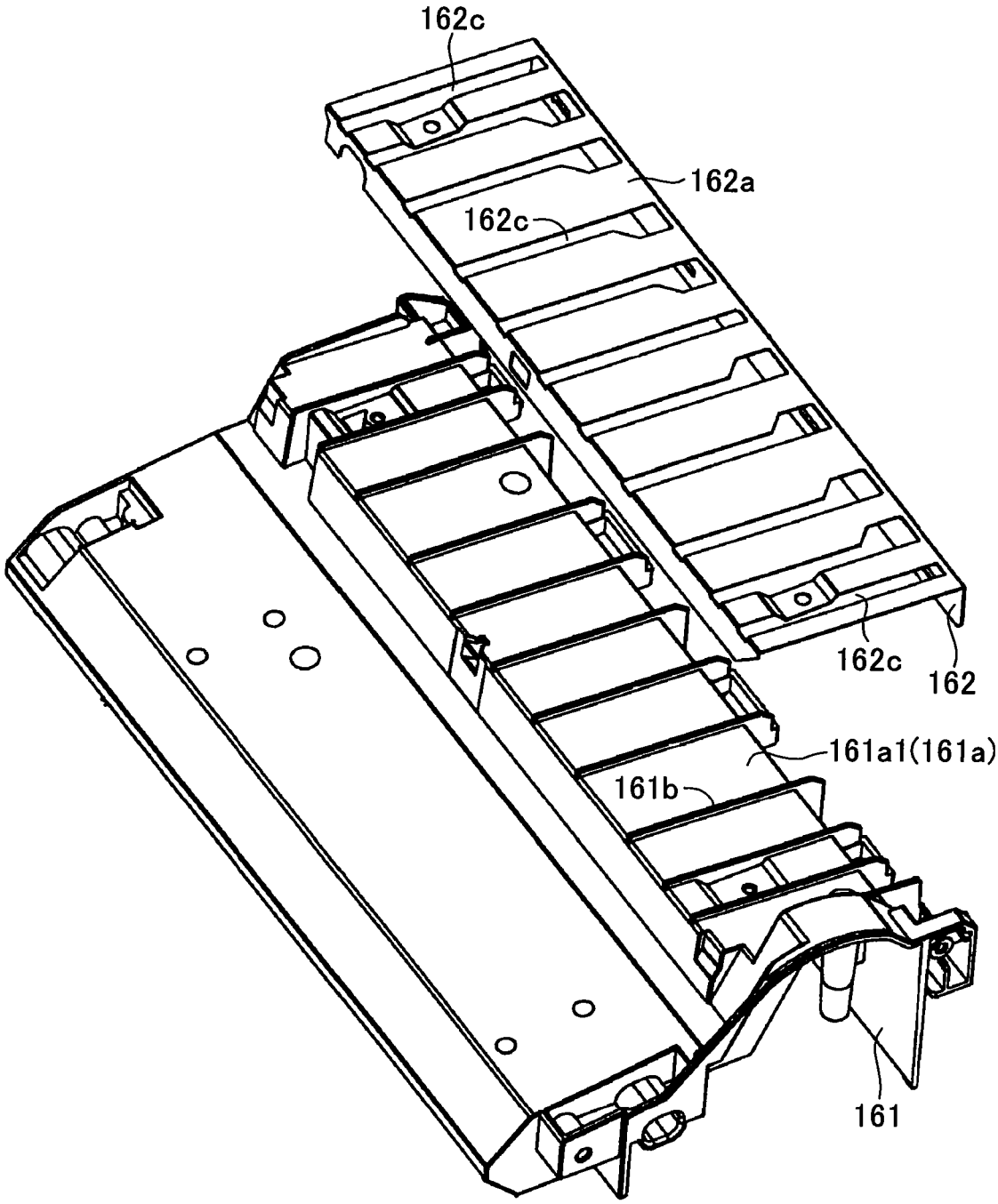
FIG. 3 is an exploded perspective view of the unfixed-image-bearing-paper transport guide shown in FIG. 2.

Configuration of Covering Metal Sheet:

FIG. 3 is an exploded perspective view of the unfixed-image-bearing-paper transport guide 160 shown in FIG. 2. With reference to FIG. 3, the flat-sheet-like covering portion 162a of the covering metal sheet 162 is divided into a plurality of portions along the width direction (paper width direction) by a plurality of slits 162c.

The slits 162c are formed so as to expose the respective guide ribs 161b upward. The width of the slit 162c is set 2 mm or more greater than the width of the guide rib 161b. Specifically, the width of the slit 162c is set to 4.5 mm.

That is, in the present embodiment, a clearance of approximately 3.3 mm is formed between a side surface of the guide rib 161b having a width of 1.2 mm and an edge of the opening of the slit 162c having a width of 4.5 mm. Also, in the present embodiment, the guide surface 161a1 of the paper-transport-path-facing portion 161a is exposed upward (toward the paper transport path PP in FIG. 2) through the approximately-3.3 mm clearances.

Furthermore, in the present embodiment, the slits 162c allow upward exposure therethrough of approximately 25% of the upper surface of the guide body 161 including the guide surface 161*a*1 and the guide ribs 161*b* of the paper-transport-path-facing portion 161*a*. The covering portion 162*a* covers the remaining portion of the upper surface of the guide body 161 other than the portion exposed upward through the slits 162*c*.

Outline of Image-Forming Operation of Laser Printer:

The outline of image-forming operation of the laser printer 100 having the above-mentioned configuration will next be described with reference to the drawings.

Paper Feed Operation:

With reference to FIG. 1, the feeder case 121 accommodates a stack of sheets of paper. The paper-pressing plate 122 biases the stacked sheets of paper upward toward the pick-up roller 112. This causes the top sheet of paper in the feeder case 121 to come into contact with the circumferential surface of the pick-up roller 112.

When the pick-up roller 112 is rotatably driven counterclockwise in FIG. 1, a leading end portion of the top sheet of paper moves rightward in FIG. 1. However, paper-to-paper friction may cause not only the top sheet of paper but also several sheets of paper under the top sheet of paper to move rightward in FIG. 1 together with the top sheet of paper. In this case, the leading ends of the upper several sheets of paper including the top sheet of paper in the feeder case 121 are caught between the separating roller 113 and the separating pad 124.

In this state, the separating roller 113 is rotatably driven counterclockwise in FIG. 1. At this time, a frictional force between the circumferential surface of the separating roller 113 and the top sheet of paper is greater than a frictional force between sheets of paper. Thus, a leading end portion of the top sheet of paper in contact with the circumferential surface of the separating roller 113 can move in association with rotation of the separating roller 113. Meanwhile, a slip arises between the top sheet of paper and the next top sheet of paper. Also, the separating pad 124 prevents movement of the leading ends of the sheets of paper under the top sheet of paper.

As mentioned above, only the top sheet of paper in contact with the circumferential surface of the separating roller 113 moves in association with rotation of the separating roller 113. The leading end of this top sheet of paper is led toward the resist section, where the opposite roller 138 and the resist roller 117 are in contact with each other.

The leading end of paper butts against the resist section, whereby a skew of the paper is corrected. Subsequently, the resist roller 117 is rotatably driven at predetermined timing. This causes the opposite roller 138 to rotate as a result of being dragged by rotation of the resist roller 117. Thus, paper is transported toward the transfer position, where the photoconductor drum 135 and the transfer roller 137 face each other. In this manner, a skew of paper is corrected, and transport timing is adjusted.

Subsequently, paper enters the image-forming unit 130 through the paper inlet opening 131*c*. A toner image is formed (transferred) on the upper surface of paper at the transfer position in the image-forming unit 130 as described below.

Formation of Electrostatic Latent Image:

In the course of above-mentioned transport of paper toward the transfer position, a toner image is carried on the circumferential surface of the photoconductor drum 135 as described below.

First, the charger 136 uniformly charges a portion of the circumferential surface of the photoconductor drum 135 which is located immediately under the charger 136. Rotation of the photoconductor drum 135 in the direction represented by the arrow in FIG. 1 (clockwise) brings the portion of the circumferential surface of the photoconductor drum 135 which is charged by the charger 136, to a position facing the laser irradiation opening 131*b*.

At the position facing the laser irradiation opening 131*b*, the scanner unit 140 irradiates the uniformly charged portion of the circumferential surface of the photoconductor drum 135 with a laser beam. Rotation of the polygon mirror 142 causes this laser beam to sweep in the width direction. This laser beam is generated on the basis of image data. That is, the light-emitting state (ON/OFF pulses) of the laser beam is modulated in accordance with image data.

The thus-modulated laser beam sweeps the charged portion of the circumferential surface of the photoconductor drum 135, thereby forming an electrostatic latent image on the charged portion of the circumferential surface. Rotation of the photoconductor drum 135 in the direction represented by the arrow in FIG. 1 (clockwise) brings the electrostatic latent-image-bearing portion of the circumferential surface of the photoconductor drum 135 to a position where the portion comes into contact with or close to the circumferential surface of the developing roller 134.

Development of Electrostatic Latent Image and Transfer of Toner Image:

As mentioned above, the developing roller 134 and the feed roller 133 rotate in the direction represented by the respective arrows in FIG. 1 (counterclockwise). This causes generation of friction therebetween at a position where the feed roller 133 is in contact with the circumferential surface of the developing roller 134. This friction causes a charged toner to be carried on the circumferential surface of the developing roller 134.

Rotation of the developing roller 134 in the direction represented by the arrow in FIG. 1 (counterclockwise) brings a portion of the circumferential surface of the developing roller 134 on which toner is carried as mentioned above, to a position where the portion faces the photoconductor drum 135.

When the electrostatic latent-image-bearing portion of the circumferential surface of the photoconductor drum 135 and the charged-toner-carrying portion of the circumferential surface of the developing roller 134 come into contact with or close to each other, the toner is affixed to the image-bearing portion of the circumferential surface of the photoconductor drum 135, in a pattern corresponding to the electrostatic latent image formed on the portion of the circumferential surface of the photoconductor drum 135. That is, the electrostatic latent image on the circumferential surface of the photoconductor drum 135 is developed with the toner, whereby a toner image is carried on the circumferential surface of the photoconductor drum 135.

Clockwise (in FIG. 1) rotation of the circumferential surface of the photoconductor drum 135 brings, to the transfer position, the toner image which is carried on the circumferential surface of the photoconductor drum 135 as mentioned above. At this transfer position, the toner image is transferred onto paper from the circumferential surface of the photoconductor drum 135.

Transport of Toner-Image-Bearing Paper to Fixing Section:

Paper on which the toner image is formed (transferred) at the transfer position is ejected from the image-forming unit 130 through the paper outlet opening 131*d*. Subsequently, this paper onto which the toner image is transferred is sent to the fixing section 150 along the paper transport path PP while the back surface thereof is guided by the unfixed-image-bearing-paper transport guide 160.

With reference to FIG. 2, the static-eliminating brush 163 appropriately eliminates static from the back surface of the toner-image-transferred paper transported to the unfixed-image-bearing-paper transport guide 160. As a result, static charges remain on the back surface of paper in such an appropriate amount as to hold the toner image. Electrostatic attraction is generated between the back surface of paper on which static charges remain, and the covering portion 162*a* of the grounded covering metal sheet 162. By virtue of this electrostatic attraction, the paper is stably transported to the fixing section 150.

Fixing and Paper Ejection:

Referring again to FIG. 1, the toner-image-bearing paper transported from the unfixed-image-bearing-paper transport guide 160 is pinched between the heating roller 151 and the pressure roller 152 to thereby be pressed and heated. This fixes the toner image on the surface of paper.

Subsequently, the fixed-image-bearing paper is sent toward the fixed-image-bearing-paper delivery roller 171 through rotation of the heating roller 151 and the pressure roller 152 in the respective directions represented by the respective arrows in FIG. 1.

Then, the fixed-image-bearing paper is sent, by the fixed-image-bearing-paper delivery roller 171, toward the contact region between the paper-ejection drive roller 174 and the paper-ejection follower roller 175 while been guided by the fixed-image-bearing-paper ejection guide surface 172*a* of the fixed-image-bearing-paper guide 172, the fixed-image-bearing-paper guide roller 173, and the lower paper-ejection-port guide 111*b*3 and the upper paper-ejection-port guide 111*b*4 of the top cover 111*b*.

By means of the paper-ejection drive roller 174 being rotatably driven clockwise in FIG. 1, the fixed-image-bearing paper is ejected toward the catch tray 111*b*1 through the paper ejection port 111*b*2. In single-sided image formation, the rear end of paper passes between the paper-ejection drive roller 174 and the paper-ejection follower roller 175, whereby the paper is completely ejected through the paper ejection port 111*b*2.

Double-Sided Image Formation:

In double-sided image formation, the paper-ejection drive roller 174 is reversed before paper whose image formation on its first side is completed is completely ejected from the paper ejection port 111*b*2. Specifically, the paper-ejection drive roller 174 is rotatably driven counterclockwise in FIG. 1 before the rear end of the first-side-image-formation-completed paper which has reached near the paper ejection port 111*b*2 passes between the paper-ejection drive roller 174 and the paper-ejection follower roller 175. As a result, the rear end of the first-side-image-formation-completed paper; i.e., the front end of paper to undergo image formation on its second side, is led to the paper inversion path DP as a result of being guided by the upper paper-ejection-port guide 111*b*4.

This paper to undergo image formation on its second side is sent to the inversion tray 181 of the paper-inverting unit 180 along the paper inversion path DP formed between the paper inversion path guide 111*c*1 of the rear cover 111*c* and the fixed-image-bearing-paper suction guide surface 172*b* of the fixed-image-bearing-paper guide 172.

The paper to undergo image formation on its second side which is sent to the inversion tray 181 as mentioned above rests on the inversion tray 181 such that the first side on which an image is already formed and fixed faces upward. The leading end of this paper to undergo image formation on its second side is sent to the resist section along the inverted-paper feed path 116*a* through cooperative operation of the inverted-paper feed roller 118 and the inverted-paper feed follower roller 182. Subsequently, image formation on the second side is performed in a manner similar to that described above.

Summery of Operation/Working and Effect of the Present Embodiment:

Next, operation/working-effect of the above-described configuration of the present embodiment will be described with reference to the drawings.

With reference to FIG. 2, according to the configuration of the present embodiment, the static-eliminating brush 163 appropriately eliminates static from the back surface of the unfixed-toner-image-bearing paper such that static is not completed eliminated. This restrains excessive charge-up on the back surface of the unfixed-toner-image-bearing paper.

With reference to FIG. 3, in the configuration of the present embodiment, an appropriate clearance is formed between a side surface of the guide rib 161*b* of the guide body 161 and an edge of the opening of the slit 162*c* of the covering metal sheet 162. The guide surface 161*a*1 of the paper-transport-path-facing portion 161*a* is partially exposed upward through the clearances. Thus, as compared with the conventional configuration in which the above-mentioned clearances are not formed, the electrostatic attraction between paper and the covering metal sheet 162 is appropriately weakened.

Thus, according to the configuration of the present embodiment, while an unfixed toner image is electrostatically held on the surface of paper, the unfixed-image-bearing paper is smoothly transported. Also, occurrence of "trace of ribs" or "scatter," which could otherwise result from excessively strong or weak electrostatic attraction, is effectively restrained.

Figure 4:
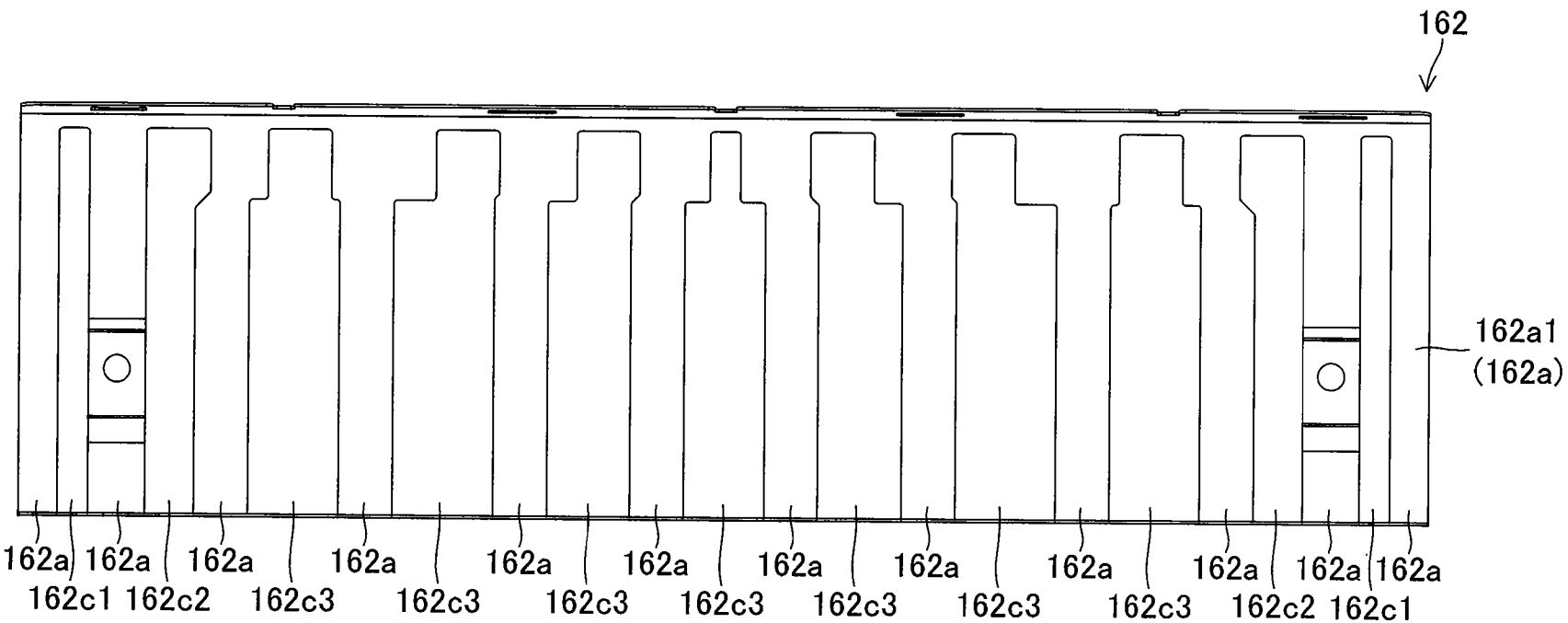
FIG. 4 is a plan view of an example of modified shape of a covering metal sheet shown in FIG. 2.

Modified Configuration of Covering Metal Sheet:

FIG. 4 is a plan view of an example of modified shape of the covering metal sheet 162 shown in FIG. 2.

With reference to FIG. 4, the covering metal sheet 162 has widthwise-endmost-portion slits 162*c*1, intermediate slits 162*c*2, and widthwise-central-portion slits 162*c*3 formed therein.

The widthwise-endmost-portion slits 162*c*1, the intermediate slits 162*c*2, and the widthwise-central-portion slits 162*c*3 are formed such that their opening widths as measured at a transport-direction central portion 162*a*1, which is a central portion of the covering portion 162*a* with respect to the paper transport direction, are distributed along the width direction as described below. As shown in FIG. 2, the transport-direction central portion 162*a*1 of the covering portion 162*a* includes a portion closest to the back surface of paper and its peripheral portion.

Referring again to FIG. 4, the widthwise-endmost-portion slits 162*c*1 are provided at endmost portions of the covering metal sheet 162 with respect to the width direction (left-right direction in FIG. 4). The widthwise-endmost-portion slit 162*c*1 has the same width and area as the aforementioned slit 162*c* as measured at the transport-direction central portion 162*a*1. Specifically, the widthwise-endmost-portion slit 162*c*1 has a width of 4.5 mm.

The intermediate slits 162*c*2 are provided inward of the widthwise-endmost-portion slits 162*c*1 with respect to the width direction. The intermediate slit 162*c*2 is wider than the widthwise-endmost-portion slit 162*c*1 as measured at the transport-direction central portion 162*a*1. Specifically, the intermediate slit 162*c*2 has a width of 7.25 mm. The intermediate slit 162*c*2 is greater in area than the widthwise-endmost-portion slit 162*c*1.

The widthwise-central-portion slits 162*c*3 are provided inward of the intermediate slits 162*c*2 with respect to the width direction. The widthwise-central-portion slit 162*c*3 is wider than the intermediate slit 162*c*2 as measured at the transport-direction central portion 162*a*1. Specifically, the widthwise-central-portion slit 162*c*3 has a width of 12 mm to 15 mm. The widthwise-central-portion slit 162*c*3 is greater in area than the intermediate slit 162*c*2.

In the covering metal sheet 162 shown in FIG. 4, 50% or more of the upper surface of the guide body 161 including the guide surface 161*a*1 and the guide ribs 161*b* of the paper-transport-path-facing portion 161*a* in FIG. 2 is exposed upward.

The configuration shown in FIG. 4 more effectively restrains occurrence of strong electrostatic attraction between unfixed-toner-image-bearing paper and the covering metal sheet 162 at a portion of the covering metal sheet 162 closest to the back surface of paper and at its peripheral portion. Thus, occurrence of "trace of ribs" or "scatter" is more effectively restrained.

Particularly, the configuration shown in FIG. 4 more effectively restrains occurrence of "trace of ribs" or "scatter" associated with image formation on the second side in double-sided image formation.

EXAMPLES

Next will be described the results of an experiment on image formation using the configuration of the present embodiment. This experiment on image formation was conducted at normal room temperature and humidity (25° C., 30%) using two types of sheets of paper and two image-forming speeds. The results are shown in the table below.

In this table, "paper P1" is A4-sized wood-free paper for printer use (trade name "P") produced by Fuji Xerox Office Supply Co., Ltd. Fibers of the paper P1 are oriented along the longitudinal direction of paper; i.e., along the paper transport direction (longitudinal fiber orientation). "Paper P2" is A4-sized plain paper (trade name "A4 (Y)" produced by FUJITSU CoWorCo LIMITED. Fibers of the paper P2 are oriented along the width direction of paper (lateral fiber orientation).

In this table, "configuration A" indicates the covering metal sheet 162 which has the slits 162*c* and is shown in FIG. 3. "Configuration B" indicates the covering metal sheet 162 which has the slits 162*c*1, 162*c*2, and 162*c*3 and is shown in FIG. 4. "First side" means the side of paper on which an image is formed, in single-sided image formation. "Second side" means the second side of paper in double-sided image formation.

Numbers in the table are of evaluation by visual inspection of formed images (degree of occurrence of abnormal image). "5" means excellent, "4" means good, and "3" means acceptable. "(2)" means unacceptable, and "(1)" means poor. The parenthesized numbers "(2)" and "(1)" are applied to the case where a user can identify an image defect easily and definitely with his/her eyes.

TABLE 1

| Paper type | Paper P1 | | | | Paper P2 | | | |
|---|---|---|---|---|---|---|---|---|
| Speed | 24 ppm | | 12 ppm | | 24 ppm | | 12 ppm | |
| Abnormal image | Trace of ribs | Scatter | Trace of ribs | Scatter | Trace of ribs | Scatter | Trace of ribs | Scatter |
| Configuration A (First side) | 5 | 5 | 5 | 5 | 5 | 5 | 5 | 5 |
| Configuration A (Second side) | 5 | (1) | 5 | (2) | 5 | 3 | 5 | 4 |
| Configuration B (Second side) | 5 | 3 | 5 | 3 | 5 | 3 | 5 | 4 |

As is apparent from the results shown in Table 1, employment of the configuration A, in which a clearance is formed between a side surface of the guide rib 161*b* and an edge of opening of the slit 162*c*, has provided good results of single-sided image formation free from an abnormal image such as "trace of ribs" or "scatter," irrespective of paper type and image-forming speed.

However, employment of the configuration A, whose degree of opening of slits is small, has suffered a marked occurrence of the abnormal image "scatter" on the second side of paper in both-sided image formation using the paper P1 with longitudinal fiber orientation, which paper is likely to curl along the paper width direction. Conceivably, this occurrence of an abnormal image is of the following mechanism.

As a result of undergoing a fixing step for image fixation on its first side, paper is heated and pressed. This causes the paper to curl along the paper width direction. When the thus-curled paper is subjected again to image formation, as is apparent from FIGS. 2 and 3, the condition of contact between the paper and the unfixed-image-bearing-paper transport guide 160 (guide ribs 161*b*) differs between a central region and end regions with respect to the paper width direction. Specifically, for example, in the central region with respect to the paper width direction, the back surface of the paper and the guide ribs 161*b* come into contact with each other most strongly.

As a result of the paper being heated in the fixing step for image fixation on its first side, the water content of the paper drops, resulting in an increase in electrostatic propensity.

As a result, friction between the paper and the unfixed-image-bearing-paper transport guide 160 (guide ribs 161*b*) causes the paper to be charged more excessively than usual. Thus, a higher voltage than usual is generated between the paper and the unfixed-image-bearing-paper transport guide 160 (guide ribs 161*b*). This causes strong attraction of the paper to the covering metal sheet 162 or occurrence of discharge at a contact region between the paper and the unfixed-image-bearing-paper transport guide 160 (guide ribs 161*b*), resulting in a marked occurrence of the above-mentioned abnormal image.

The probability (quality of being probable) for this mechanism is supported by the following facts. (a) When the image-forming speed; i.e., the paper transport speed, is high, occurrence of an abnormal image is more marked. (b) When the paper P2 with lateral fiber orientation is used, employment of even the configuration A was free from occurrence of a particular image defect on the second side of paper in both-sided image formation.

By contrast, employment of the configuration B, whose degree of opening of slits is large, provided good results of image formation on even the second side in double-sided image formation.

Several Modified Embodiments:

The above-described embodiment is a mere example of a typical embodiment of the present invention which the applicant of the present invention considered to be the best at the time of filing the application. The present invention is not limited thereto, but may be modified in various other forms without deviating from the gist of the invention.

Several modified embodiments are exemplified below, but these modified embodiments are to be considered not restrictive.

Limitingly interpreting the present invention based on the above embodiment and the following modified embodiments (particularly, limitingly interpreting those operationally and functionally expressed elements which partially constitute the means for solving the problems to be solved by the present invention, based on the description of the above embodiment and the following modified embodiments) is not allowed. Such limited interpretation unfairly impairs the interests of the applicant and unfairly benefits imitators.

(i) Applications of the present invention are not limited to electrophotographic image-forming apparatus such as laser printers. For example, the present invention may be suitably applied to image-forming apparatus of the ion flow type and the toner jet type.

A specific configuration composed of the feeder unit 120, the image-forming unit 130, the scanner unit 140, and the like is not directly related to the essentials of the present invention. The configuration is not limited to that disclosed in the above embodiment, but may be modified in various other forms. For example, even when the feeder unit 120 is eliminated, and manual feed of paper is employed instead, the present invention may be suitably applied.

(ii) The guide surface 161*a*1 of the paper-transport-path-facing portion 161*a* and the covering portion 162*a* in FIG. 2 may be curved along the paper transport path PP. The guide rib 161*b* may be formed such that the ridgeline thereof, which extends along the paper transport path PP as shown in FIG. 2, assumes a curve that completely coincides with the paper transport path PP.

(iii) The number and shape of ribs and slits are not limited to those shown in FIGS. 3 and 4.

In the case where a distribution along the width direction is employed with respect to the clearance between the rib and the slit as well as the area of the slit, there may be formed a region where the clearance is almost not formed.

Figure 5:
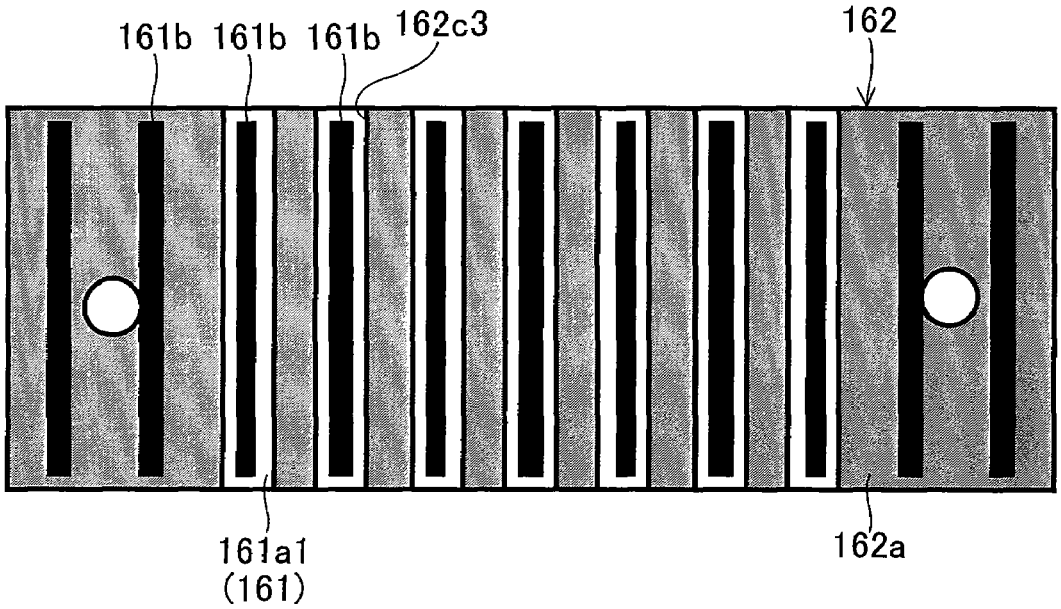
FIG. 5 is a plan view of a modified embodiment of the covering metal sheet shown in FIG. 2.

Specifically, for example, the width of the widthwise-end-most-portion slit 162*c*1 and/or the intermediate slit 162*c*2 in FIG. 4 may be substantially equal to the width of the guide rib 161*b* in FIG. 2. In this case, as shown in FIG. 5, wide widthwise-central-portion slits 162*c*3 are formed only at a central portion of the covering metal sheet 162 with respect to the width direction, and a clearance between the guide rib 161*b* and the covering portion 162*a* is formed only at the central portion of the covering metal sheet 162 with respect to the width direction.

Figure 6:
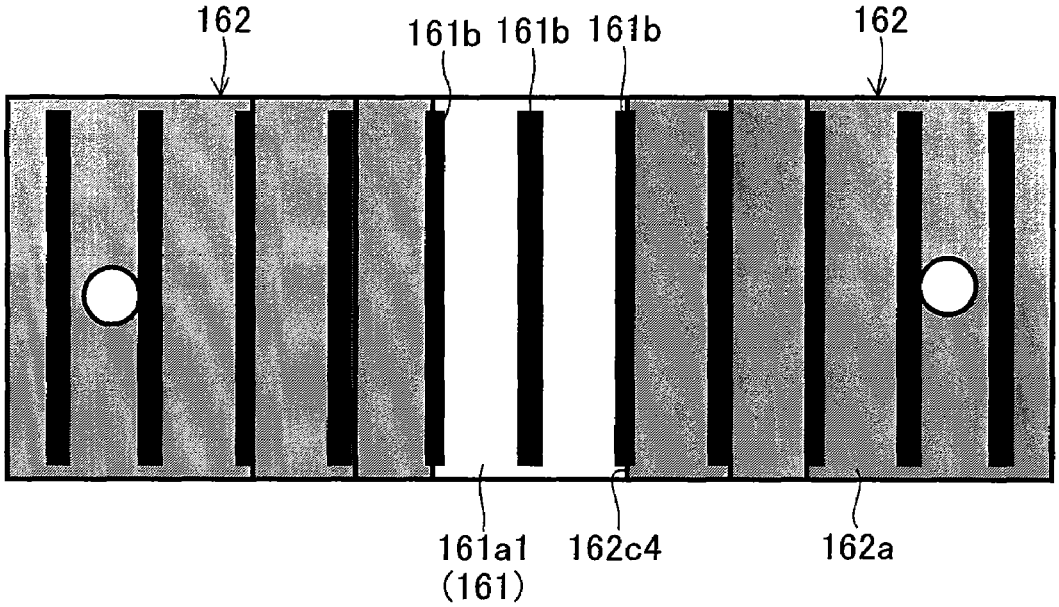
FIG. 6 is a plan view of another modified embodiment of the covering metal sheet shown in FIG. 2.

Alternatively, as shown in FIG. 6, the covering portion 162*a* may be absent between the adjacent guide ribs 161*b* at a central portion of the guide body 161 with respect to the width direction. That is, a central portion of the covering metal sheet 162 with respect to the width direction may have an opening portion 162*c*4 for allowing a plurality of adjacent guide ribs 161*b* and an associated portion of the guide surface 161*a*1 to be exposed therethrough.

In this case, the covering metal sheet 162 may be divided into left and right pieces in FIG. 6 at a central portion where the guide surface 161*a*1 is exposed through the opening portion 162*c*4. In other words, configuration may be such that the opening portion 162*c*4 for allowing a portion of the guide surface 161*a*1 to be exposed therethrough is formed between two covering metal sheets 162.

Figure 7:
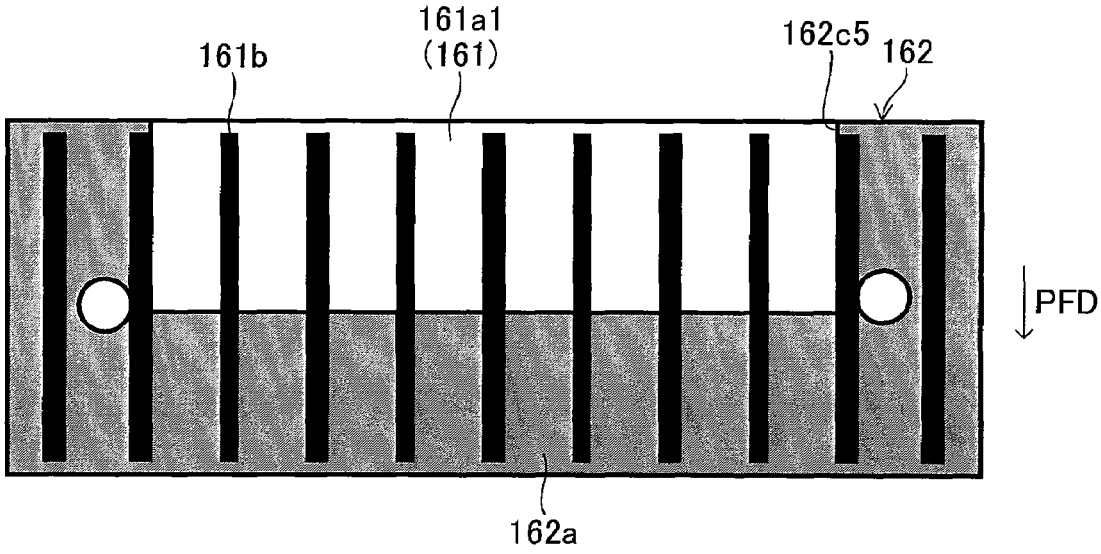
FIG. 7 is a plan view of still another modified embodiment of the covering metal sheet shown in FIG. 2.

(iii) As shown in FIG. 7, an opening portion 162*c*5 through which the guide surface 161*a*1 and a plurality of guide ribs 161*b* are partially exposed may be formed in the covering metal sheet 162 at an upstream portion with respect to a paper transport direction PFD and a central portion with respect to the width direction.

Figure 8:
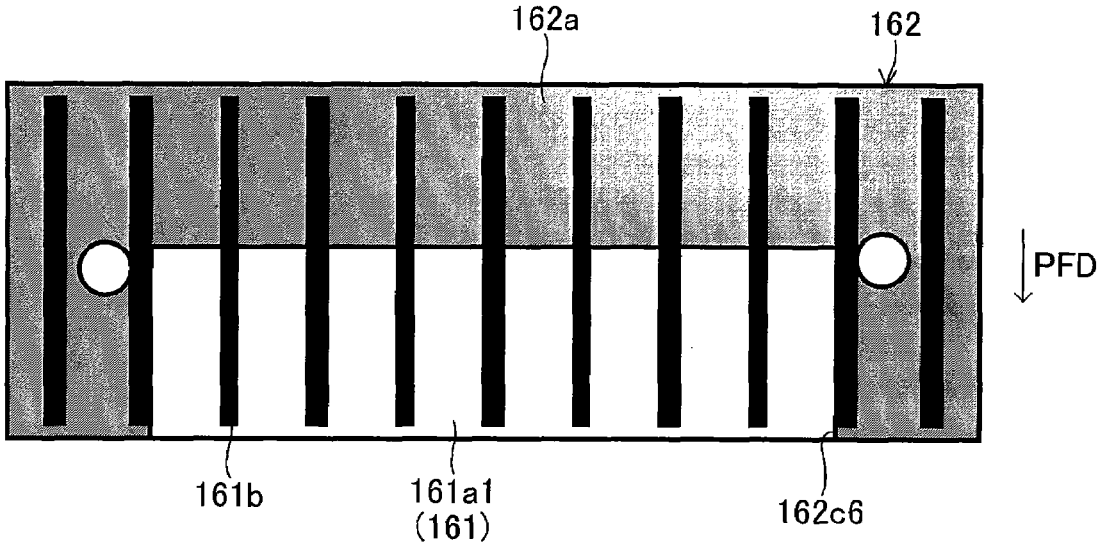
FIG. 8 is a plan view of a further modified embodiment of the covering metal sheet shown in FIG. 2.

As shown in FIG. 8, an opening portion 162*c*6 through which the guide surface 161*a*1 and a plurality of guide ribs 161*b* are partially exposed may be formed in the covering metal sheet 162 at a downstream portion with respect to the paper transport direction PFD and a central portion with respect to the width direction.

(iv) Those operationally and functionally expressed elements which partially constitute the means for solving the problems to be solved by the present invention include the specific structures disclosed in the above embodiment and modified embodiments and any structures which can implement the operation and functions.

What is claimed is:

1. An image-forming apparatus comprising:

a developing-agent-image-forming section configured to affix a charged-developing agent to a surface of a recording medium in a pattern corresponding to an image;

a fixing section configured to fix the image in the developing agent on the recording medium; and a recording-medium guide section disposed between the developing-agent-image-forming section and the fixing section to face a back surface of the recording medium and configured to guide transport of the recording medium bearing the image formed at the developing-agent-image-forming section to the fixing section, wherein the recording-medium guide section comprises:

a guide member having a facing surface in opposition to the back surface of the recording medium and a plurality of ribs provided on the facing surface in a standing condition; and an electrically conductive member having opening portions for allowing exposure therethrough of a portion of the facing surface of the guide member and the ribs of the guide member toward the back surface of the recording medium, and configured to cover the remaining portion of the facing surface, wherein the electrically conductive member is configured such that the opening portions are greater in width than portions covering the facing surface, wherein the facing surface has an electrical insulation property, and wherein the rib and the opening portion are formed along the recording-medium transport direction, and the width of the opening portion is along a direction which is perpendicular to the recording-medium transport direction.

2. An image-forming apparatus comprising:

a developing-agent-image-forming section configured to affix a charged-developing agent to a surface of a recording medium in a pattern corresponding to an image;

a fixing section configured to fix the image in the developing agent on the recording medium; and a recording-medium guide section disposed between the developing-agent-image-forming section and the section to face a back surface of the recording medium and configured to guide transport of the recording medium bearing the image formed at the developing-agent-image-forming section to the fixing section, wherein the recording-medium guide section comprises:

a guide member having a facing surface in opposition to the back surface of the recording medium and a plurality of ribs provided on the facing surface in a standing condition; and an electrically conductive member having opening portions for allowing exposure therethrough of a portion of the facing surface of the guide member and the ribs of the guide member toward the back surface of the recording medium, and configured to cover the remaining portion of the facing surface, wherein the electrically conductive member is configured such that the opening portions are greater in width than the portions covering the facing surface as compared in a central region thereof with respect to a transport direction of the recording medium.

3. An image-forming apparatus according to claim 2, wherein the electrically conductive member is configured such that the width of the opening portions differs between a central region and end regions thereof with respect to a width direction perpendicular to a thickness direction of the recording medium and to the transport direction of the recording medium.

4. An image-forming apparatus according to claim 3, wherein the electrically conductive member is configured such that the opening portions are greater in area than the portions covering the facing surface.

5. An image-forming apparatus according to claim 4, wherein the electrically conductive member is configured such that the area of each opening portion differs between a central region and end regions thereof with respect to a width direction perpendicular to a thickness direction of the recording medium and to the transport direction of the recording medium.

6. An image-forming apparatus according to claim 5, wherein the electrically conductive member is configured such that the opening portions are greater in area than the portions covering the facing surface as compared in the central region thereof with respect to the transport direction of the recording medium.

7. An image-forming apparatus according to claim 6, further comprising a paper-inverting mechanism configured to invert the recording medium which has passed through the fixing section and on which the image in the developing agent is fixed and to refeed the inverted recording medium to the developing-agent-image-forming section.

8. An image-forming apparatus comprising:

a developing-agent-image-forming section configured to affix a charged-developing agent to a surface of a recording medium in a pattern corresponding to an image a fixing section configured to fix the image in the developing agent on the recording medium; and a recording-medium guide section disposed between the developing-agent-image-forming section and the fixing section to face a back surface of the recording medium and configured to guide transport of the recording medium bearing the image formed at the developing-agent-image-forming section to the fixing section, wherein the recording-medium guide section comprises:

a guide member having a facing surface in opposition to the back surface of the recording medium and a plurality of ribs provided on the facing surface in a standing condition; and an electrically conductive member having opening portions for allowing exposure therethrough of a portion of the facing surface of the guide member and the ribs of the guide member toward the back surface of the recording medium, and configured to cover the remaining portion of the facing surface, wherein the electrically conductive member is configured such that the opening portions are greater in width than portions covering the facing surface, and wherein the electrically conductive member is configured such that the width of the opening portions differs between a central region and end regions thereof with respect to a width direction perpendicular to a thickness direction of the recording medium and to the transport direction of the recording medium.

9. An image-forming apparatus according to claim 1, further comprising a paper-inverting mechanism configured to invert the recording medium which has passed through the fixing section and on which the image in the developing agent is fixed and to refeed the inverted recording medium to the developing-agent-image-forming section.

10. An image-forming apparatus comprising:

a developing-agent-image-forming section configured to affix a charged-developing agent to a surface of a recording medium in a pattern corresponding to an image;

a fixing section configured to fix the image in the developing agent on the recording medium; and a recording-medium guide section disposed between the developing-a gent-image-forming section and the fixing section to face a back surface of the recording medium and configured to guide transport of the recording medium bearing the image formed at the developing-agent-image-forming section to the fixing section, wherein the recording-medium guide section comprises:

a guide member having a facing surface in opposition to the back surface of the recording medium and a plurality of ribs provided on the facing surface in a standing condition; and an electrically conductive member having opening portions for allowing exposure therethrough of a portion of the facing surface of the guide member and the ribs of the guide member toward the back surface of the recording medium, and configured to cover the remaining portion of the facing surface, wherein the electrically conductive member is configured such that the opening portions are greater in area than the portions covering the facing surface.

11. An image-forming apparatus according to claim 10, wherein the electrically conductive member is configured such that the area of each opening portion differs between a central region and end regions thereof with respect to a width direction perpendicular to a thickness direction of the recording medium and to the transport direction of the recording medium.

12. An image-forming apparatus according to claim 11, wherein the electrically conductive member is configured such that the opening portions are greater in area than the portions covering the facing surface as compared in the central region thereof with respect to the transport direction of the recording medium.

13. An image-forming apparatus according to claim 12, further comprising a paper-inverting mechanism configured to invert the recording medium which has passed through the fixing section and on which the image in the developing agent is fixed and to refeed the inverted recording medium to the developing-agent-image-forming section.

14. An image-forming apparatus comprising:

a developing-agent-image-forming section configured to affix a charged-developing agent to a surface of a recording medium in a pattern corresponding to an image;

a fixing section configured to fix the image in the developing agent on the recording medium; and a recording-medium guide section disposed between the developing-agent-image-forming section and the fixing section to face a back surface of the recording medium and configured to guide transport of the recording medium bearing the image formed at the developing-agent-image-forming section to the fixing section, wherein the recording-medium guide section comprises:

a guide member having a facing surface in opposition to the back surface of the recording medium and a plurality of ribs provided on the facing surface in a standing condition; and an electrically conductive member having opening portions for allowing exposure therethrough of a portion of the facing surface of the guide member and the ribs of the guide member toward the back surface of the recording medium, and configured to cover the remaining portion of the facing surface, wherein the electrically conductive member is configured such that the area of each opening portion differs between a central region and end regions thereof with respect to a width direction perpendicular to a thickness direction of the recording medium and to the transport direction of the recording medium.

15. An image-forming apparatus according to claim 14, wherein the electrically conductive member is configured such that the opening portions are greater in area than the portions covering the facing surface as compared in the central region thereof with respect to the transport direction of the recording medium.

16. An image-forming apparatus according to claim 15, further comprising a paper-inverting mechanism configured to invert the recording medium which has passed through the fixing section and on which the image in the developing agent is fixed and to refeed the inverted recording medium to the developing-agent-image-forming section.

17. An image-forming apparatus according to claim 14, wherein the electrically conductive member is grounded.

18. An image-forming apparatus according to claim 1, wherein the electrically conductive member is grounded.

19. An image-forming apparatus according to claim 1, wherein the electrically conductive member is configured such that the opening portions are greater in width than the portions covering the facing surface as compared in a central region thereof with respect to a transport direction of the recording medium.

20. An image-forming apparatus according to claim 1, wherein the electrically conductive member is configured such that the width of the opening portions differs between a central region and end regions thereof with respect to a width direction perpendicular to a thickness direction of the recording medium and to the transport direction of the recording medium.

21. An image-forming apparatus according to claim 20, wherein the electrically conductive member is configured such that the opening portions are greater in area than the portions covering the facing surface.

22. An image-forming apparatus according to claim 21, wherein the electrically conductive member is configured such that the area of each opening portion differs between a central region and end regions thereof with respect to a width direction perpendicular to a thickness direction of the recording medium and to the transport direction of the recording medium.

23. An image-forming apparatus according to claim 22, wherein the electrically conductive member is configured such that the opening portions are greater in area than the portions covering the facing surface as compared in the central region thereof with respect to the transport direction of the recording medium.

24. An image-forming apparatus according to claim 23, further comprising a paper-inverting mechanism configured to invert the recording medium which has passed through the fixing section and on which the image in the developing agent is fixed and to refeed the inverted recording medium to the developing-agent-image-forming section.

25. An image-forming apparatus according to claim 2, wherein the electrically conductive member is grounded.

26. An image-forming apparatus according to claim 8, wherein the electrically conductive member is grounded.

27. An image-forming apparatus according to claim 10, wherein the electrically conductive member is grounded.

* * * * *